US007891284B1

(12) United States Patent
Barrett

(10) Patent No.: US 7,891,284 B1
(45) Date of Patent: Feb. 22, 2011

(54) FIREARM WITH GAS SYSTEM ACCESSORY LATCH

(76) Inventor: Christopher Gene Barrett, 8634 E. Gum Rd., Murfreesboro, TN (US) 37127

( * ) Notice: Subject to any disclaimer, the term of this patent is extended or adjusted under 35 U.S.C. 154(b) by 784 days.

(21) Appl. No.: 11/810,790

(22) Filed: Jun. 6, 2007

(51) Int. Cl.
*F41A 5/00* (2006.01)

(52) U.S. Cl. ..... 89/193; 89/140; 89/191.01; 89/14.4

(58) Field of Classification Search ..... 89/193, 89/140, 191.01, 14.4, 14.05; 42/1.06
See application file for complete search history.

(56) References Cited

U.S. PATENT DOCUMENTS

| | | | | | |
|---|---|---|---|---|---|
| 1,431,059 | A | * | 10/1922 | Sutter | 89/193 |
| 2,058,897 | A | * | 10/1936 | Marek | 89/193 |
| 2,341,680 | A | * | 2/1944 | Williams | 89/193 |
| 2,348,872 | A | * | 5/1944 | Williams et al. | 89/193 |
| 2,390,738 | A | * | 12/1945 | Rutherford et al. | 42/105 |
| 2,416,287 | A | * | 2/1947 | Coates et al. | 42/105 |
| 2,437,548 | A | * | 3/1948 | Patchett | 42/72 |
| 2,462,119 | A | * | 2/1949 | Moore | 89/193 |
| 2,715,355 | A | * | 8/1955 | Garand | 89/140 |
| 2,748,662 | A | * | 6/1956 | Simpson | 89/193 |
| 2,783,685 | A | * | 3/1957 | Green | 89/193 |
| 2,807,112 | A | * | 9/1957 | Garand | 42/105 |
| 2,941,450 | A | * | 6/1960 | Crittendon et al. | 89/191.01 |
| 3,020,807 | A | * | 2/1962 | Hailston et al. | 89/193 |
| 3,110,222 | A | * | 11/1963 | Harvey | 89/159 |
| 3,174,401 | A | * | 3/1965 | Beretta | 89/192 |
| 3,225,657 | A | * | 12/1965 | Kruzell | 89/187.01 |
| 3,427,924 | A | * | 2/1969 | Johnsen | 89/135 |
| 3,657,960 | A | * | 4/1972 | Badali | 89/191.02 |
| 3,968,727 | A | * | 7/1976 | Hyytinen | 89/191.02 |
| 4,085,654 | A | * | 4/1978 | Panigoni | 89/191.02 |
| 4,389,920 | A | * | 6/1983 | Dufour, Sr. | 89/190 |
| 4,409,883 | A | * | 10/1983 | Nyst | 89/192 |
| 4,418,608 | A | * | 12/1983 | Klumpp | 89/193 |
| 4,433,611 | A | * | 2/1984 | Baumann | 89/193 |
| 5,272,956 | A | * | 12/1993 | Hudson | 89/128 |
| 5,831,202 | A | * | 11/1998 | Rustick | 89/193 |
| 5,945,626 | A | * | 8/1999 | Robbins | 89/193 |
| 6,065,384 | A | * | 5/2000 | Widder et al. | 89/14.05 |
| 6,619,592 | B2 | * | 9/2003 | Vignaroli et al. | 89/191.01 |
| 7,610,844 | B2 | * | 11/2009 | Kuczynko et al. | 89/193 |
| 2006/0065112 | A1 | * | 3/2006 | Kuczynko et al. | 89/193 |
| 2009/0229454 | A1 | * | 9/2009 | Fluhr et al. | 89/193 |
| 2010/0095834 | A1 | * | 4/2010 | Kuczynko et al. | 89/193 |

* cited by examiner

*Primary Examiner*—Michelle Clement
(74) *Attorney, Agent, or Firm*—Bennet K. Langlotz; Langlotz Patent & Trademark Works, Inc.

(57) ABSTRACT

A gas-operated firearm has a barrel defining a bore with a gas block defining a chamber communicating with the bore via a gas passage. A gas regulation element has a first position and a second position, and serves to provide different gas flow characteristics in the different positions. The latch element gives the user audible or tactile feedback upon installation of an accessory device when the gas regulation element is a correct position suited to use of the accessory, and not when in the other position unsuited to accessory usage. The accessory may be a sound suppressor, and the latch may serve to secure the gas regulation element against position change. The latch may engage a circular array of elements on the rear face of the suppressor, and may have an angled cam face to provide ratcheting engagement for installation, and to resist removal or loosening without deliberate actuation of the latch.

24 Claims, 12 Drawing Sheets

FIREARM WITH GAS SYSTEM ACCESSORY LATCH

FIELD OF THE INVENTION

This invention relates to firearms, and more particularly to gas-operated self-loading firearms.

BACKGROUND AND SUMMARY OF THE INVENTION

Auto-loading rifles generally employ the energy produced in firing a round to cycle a bolt (bolt carrier and bolt) and load the next round. This includes machine guns and semi-automatic rifles of many types.

One type of system for transferring energy to the bolt employs the gas pressure developed behind the bullet in the barrel upon discharge. This is know as a direct-gas operated system. A small lateral vent hole is provided in the barrel (usually at a forward location), and the momentary gas pressure is transmitted through the vent hole back to the bolt assembly to cycle it. In direct-gas-operated rifles (such as an M16 or M4 rifle) the gas pressure is transmitted via a tube that extends back to the bolt, which has a piston-like portion to which the gas imparts pressure. In others (such as an M14) the gas pressure enters a cylindrical chamber, where a piston connected via a rod transmits the force back to the bolt assembly. This may either push the bolt assembly so that the rod and bolt assembly initially move together, or the rod may "tap" the bolt assembly, providing an impulse to move the bolt assembly rearward in its cycle.

The degree of force generated by the gas pressure is desired to remain in a selected range. Inadequate pressure can cause the firearms to fail to fully cycle, thus failing to chamber a round. Excessive pressure can cause excessive wear, and may damage components, as well as causing unreliable performance. Therefore, the aperture used to admit gas to the gas block from the barrel is carefully sized based on engineering principles, as is the aperture that allows gas from the gas block to vent to atmosphere. Each of these affect operation.

In some firearms, several apertures of different sizes are provided, with a rotating plug having the different sized apertures, so that whichever aperture is positioned over the gas passage from the barrel will determine the amount of gas admitted to the gas block. This permits the use of ammunition with different characteristics, and can compensate for powder fouling that can occlude or reduce the effective diameter of an aperture, reducing its gas transmission capability. In other versions, the variable aperture principle is applied to the aperture that vents the gases from the gas block, with a larger atmospheric vent aperture diminishing the pressure and duration in the gas block, for reduced action energy, and a smaller aperture maintaining and sustaining pressure at a higher level for increased action energy.

Other purposes of the selectable aperture diameter include the use of muzzle-mounted sound suppressors, which reduce the sound of the report generated upon firing. These briefly capture the pressurized gases emitted from the muzzle upon firing, so that the impulse is absorbed and spread out. The resulting peak pressure reduction provides a drastically reduced report. Suppressors also have the effect of increasing "backpressure," because the moderately high pressure gases temporarily stored serve to slow the rate at which barrel bore pressures decline after the bullet exits the muzzle. This means that there is more pressure, working for a longer duration on the gas system. Consequently, the gas system should generally be set to a smaller aperture when suppressors are used, to avoid the problems with an over-pressurized gas system.

While such gas system adjustments are satisfactory for use with suppressors, problems can occur when a user installs a suppressor, but forgets to set the gas plug to a smaller aperture. This can cause unwanted damage, or a failure of the firearm to properly perform (with potentially dire consequences in a combat or self-defense context.)

The present invention overcomes the limitations of the prior art by providing a gas-operated firearm having a barrel defining a bore with a gas block defining a chamber communicating with the bore via a gas passage. A gas regulation element has a first position and a second position, and serves to provide different gas flow characteristics in the different positions. The latch element gives the user audible or tactile feedback upon installation of an accessory device when the gas regulation element is a correct position suited to use of the accessory, and not when in the other position unsuited to accessory usage. The accessory may be a sound suppressor, and the latch may serve to secure the gas regulation element against position change. The latch may engage a circular array of elements on the rear face of the suppressor, and may have an angled cam face to provide ratcheting engagement for installation, and to resist removal or loosening without deliberate actuation of the latch.

DETAILED DESCRIPTION OF A PREFERRED EMBODIMENT

Figure 1:
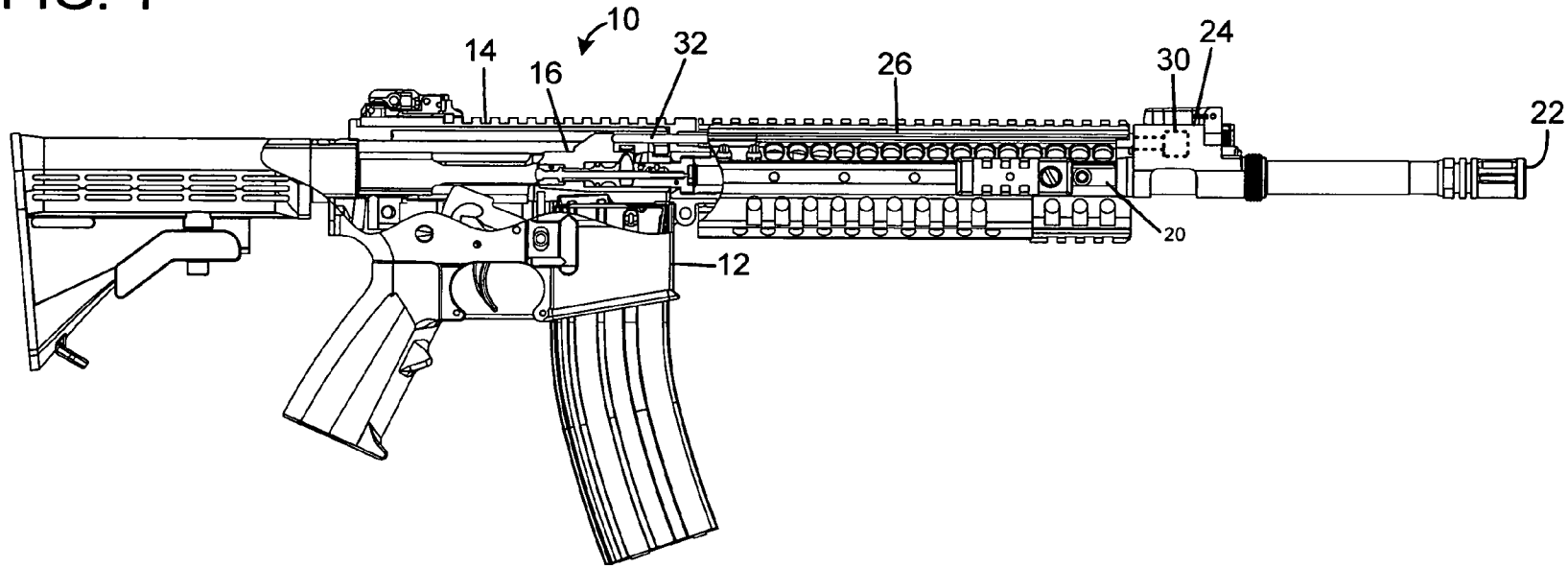
FIG. 1 is a side view of a rifle according to a preferred embodiment of the invention.

FIG. 1 shows a rifle 10 having a lower receiver 12, and an upper receiver 14 in which a bolt assembly 16 reciprocates. A barrel 20 extends forward from the upper receiver to a muzzle end 22. A gas block 24 is mounted to the barrel at an intermediate position near the muzzle. An operating rod 26 has a cylindrical piston 30 at a forward end, and has a rear end 32 that extends into the upper receiver 14, and which is registered with a portion of the bolt assembly 16. As will be discussed below, the piston 30 is closely received within a cylindrical bore in the gas block, and a passage extends between the cylinder and the barrel bore. Upon firing, some of the pressurized column of gas behind the bullet enters the gas block chamber and forces the piston rearward. The rod then transmits energy to the bolt assembly, cycling it rearward to load another round.

Figure 2:
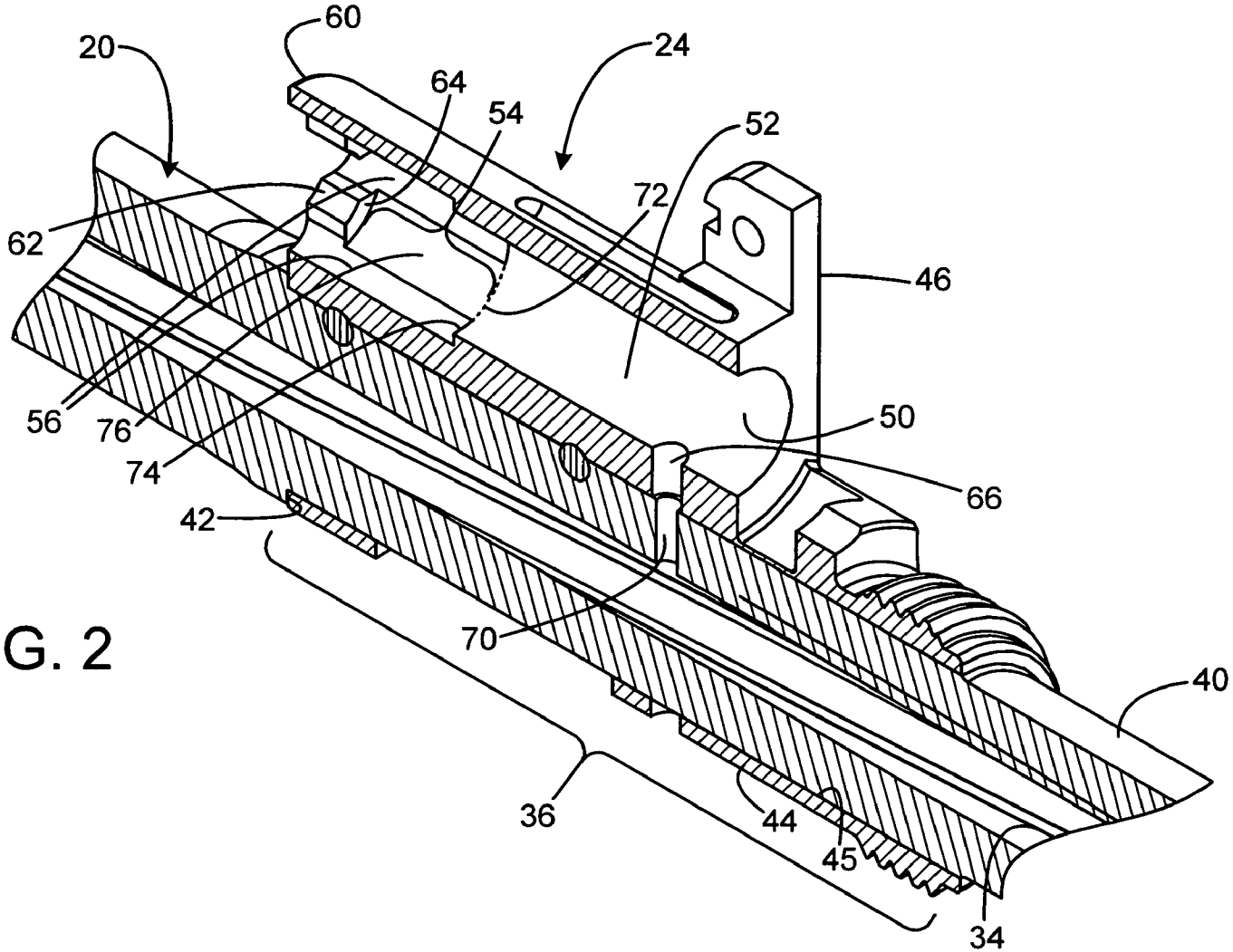
FIG. 2 is a sectional view of the rifle of the preferred embodiment.
Figure 3:
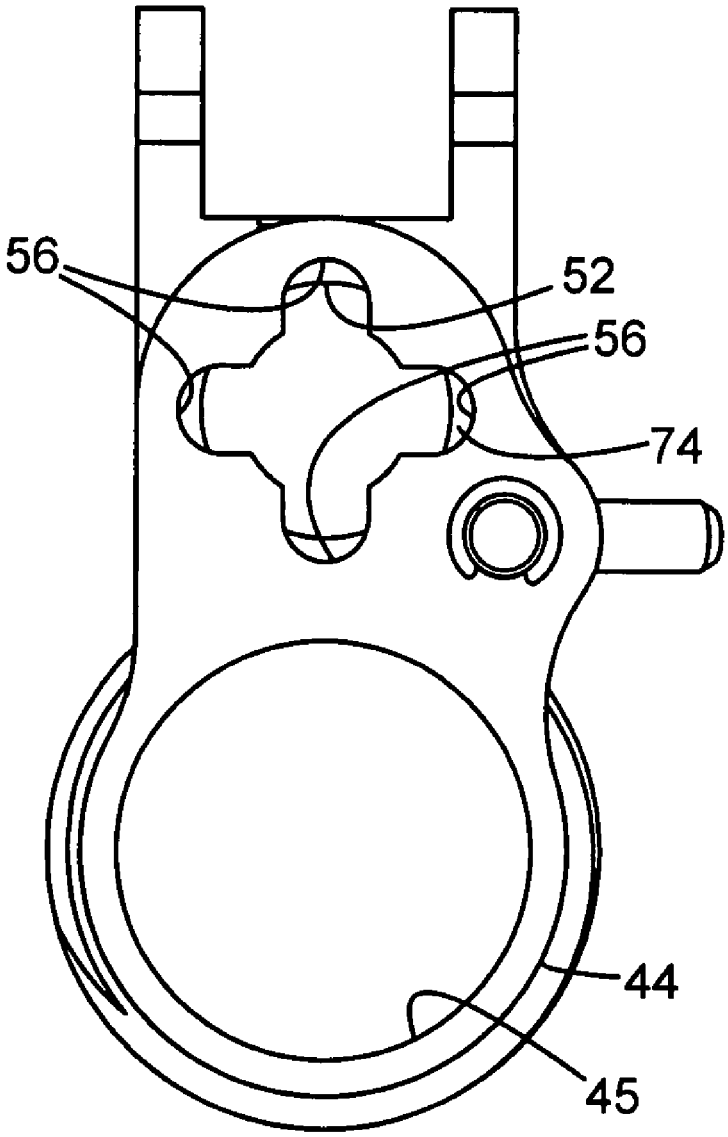
FIG. 3 is an end view of the gas block of the preferred embodiment.

FIGS. 2 and 3 show the gas block 24 as mounted on the barrel 20. The barrel bore 34 extends axially through the barrel. The barrel has an enlarged cylindrical profile portion 36 with a narrower portion 40 extending forward. At the rear of the cylindrical portion 36, a shoulder 42 is provided. The gas block 24 includes a cylindrical sleeve portion 44 defining a bore 45 that is sized for a tight press fit or low-clearance slip fit on the barrel portion 36, and has a comparable length. An upper block portion 46 extends above the sleeve portion and defines a generally cylindrical bore 50 providing a passage through the block parallel to the barrel bore.

The gas block passage 50 includes a forward portion 52 that is a straight cylindrical bore with a circular cross-section. Rearward of portion 52 is a fluted portion 54 having several axial channels or flutes 56 that extend out the rear end 60 of the gas block. The rearmost portion of the passage 50 is a shoulder portion 62 through which the flutes past, but with reduced diameter sections providing shoulders 64 that face forward. A gas passage aperture 66 is drilled laterally through the gas block toward the forward end of portion 52, and aligns with a gas passage 70 drilled in the barrel to provide communication between the barrel bore 34 and the gas block chamber.

The flutes 56 extend forward to a limit line 72 that defines the limit between the forward portion 52 and rear portion 54 of the gas block chamber. Each flute terminates at a flat surface 74 having an edge that follows the limit line 72. As shown in FIG. 3, the flutes 56 extend radially to a significantly larger diameter than the diameter of cylindrical section 52. In the preferred embodiment, the cylinder portion 52 has a diameter of 0.452 inch, and each flute extends radially beyond that by a distance of 0.042 inch. The reduced diameter at the shoulder portion 62 is 0.3126 inch. The flutes are generally semi cylindrical channels, so that they do not have any sharp internal corners that would be susceptible to fouling, and further to facilitate machining by conventional processes. The rear portion 54 of the gas block chamber includes cylindrical segments 76 that have the same diameter as the forward portion 52 and are smoothly continuous therewith. Thus, the cylindrical segment 76, and flutes 56 alternate in a rotationally symmetrical pattern as shown. In the preferred embodiment, there are four flutes and four cylindrical segments 76.

Figure 4:
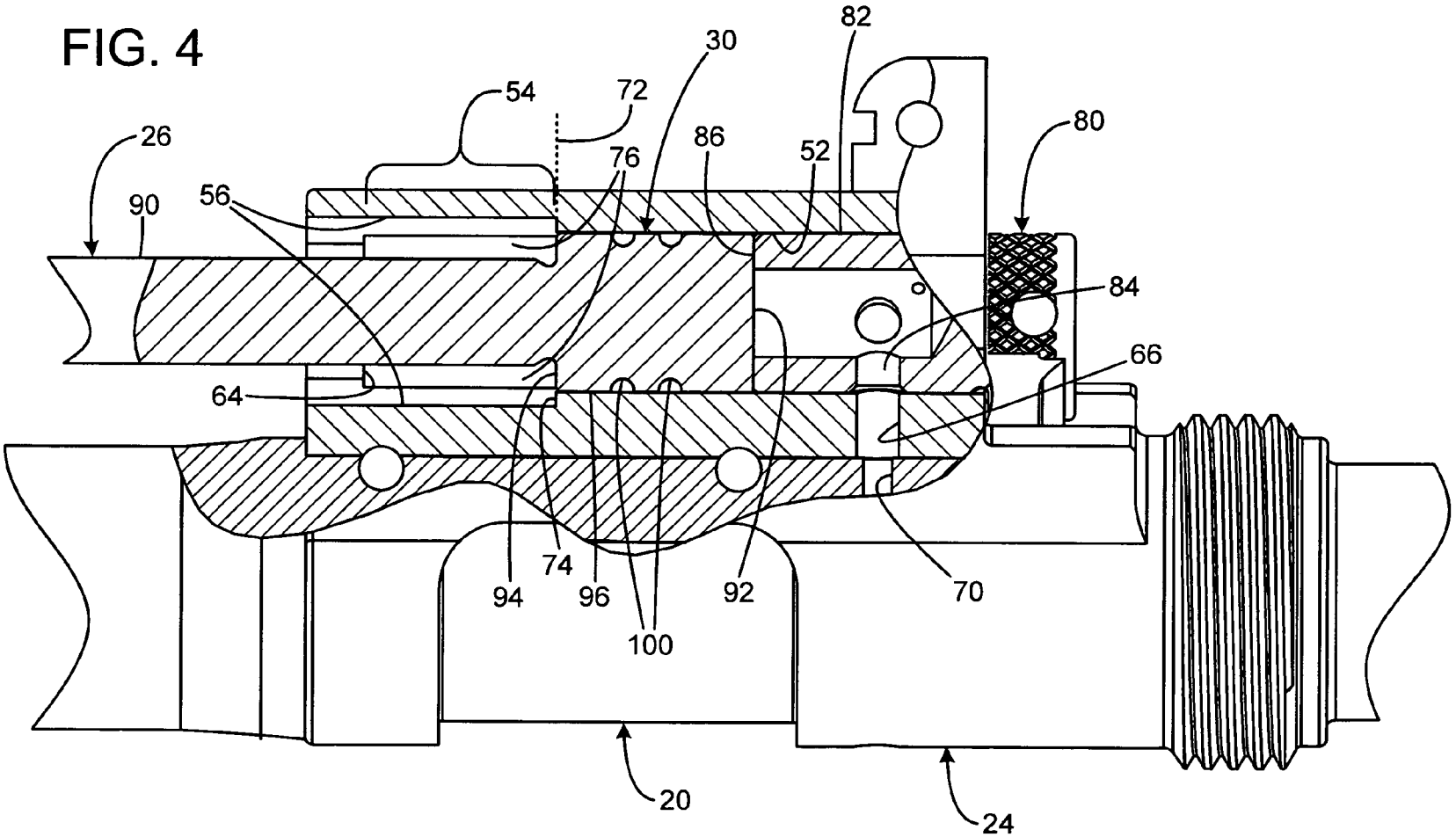
FIG. 4 is an enlarged side view of the preferred embodiment in a first operational condition.

As shown in FIG. 4, a forward gas plug 80 encloses the forward end of the gas block chamber. The plug has a cylindrical sleeve 82 that extends into the forward end of the chamber, and closely fits to seal against gas escape while permitting rotation. The sleeve has a lateral aperture 84 that may be registered with the gas hole 66 as shown to permit gas to be transmitted from the barrel bore into the chamber. The sleeve has a rear end face 86 that is flat, and perpendicular to the axis of the gas block chamber. The gas block may be provided with several different diameter apertures, so that an aperture appropriate for the circumstances may be selected. For instance, a larger aperture provides greater gas flow and therefore a greater impulse to the operating rod, while a smaller aperture reduces the force of the operating rod. The gas plug may also have a position in which no hole registers with the gas hole 66 so that the action does not cycle with each shot.

The operating rod 26 has a straight rigid elongated shank 90 having a limited diameter that readily passes through the limited aperture defined by the shoulder segment faces 62, with at least some limited clearance as illustrated. The forward end of the rod terminates with the enlarged piston 30, which has a flat circular front face 92 and a flat annular rear shoulder 94. the lateral cylindrical surface 96 of the piston is a smooth straight circular cylinder that closely fits within a cylindrical section 52 of the gas block chamber. A pair of circumferential annular grooves 100 encircles the piston at an intermediate position, spaced apart from each other. These provide a reservoir where minor fouling can accumulate without causing problems, and have edges that serve to scrape the interior of the gas block chamber as the piston cycles.

In FIG. 4, the piston is shown in a forward position to which it is normally spring biased. The face 92 of the piston abuts the rear face 86 of the plug, and the entire piston is surrounded by the forward portion 52 of the chamber. In the illustrated embodiment, the rear shoulder 94 of the piston aligns with the plane 72 defined by the forward end faces 74 of flutes 56, although this may vary as discussed below.

Figure 5:
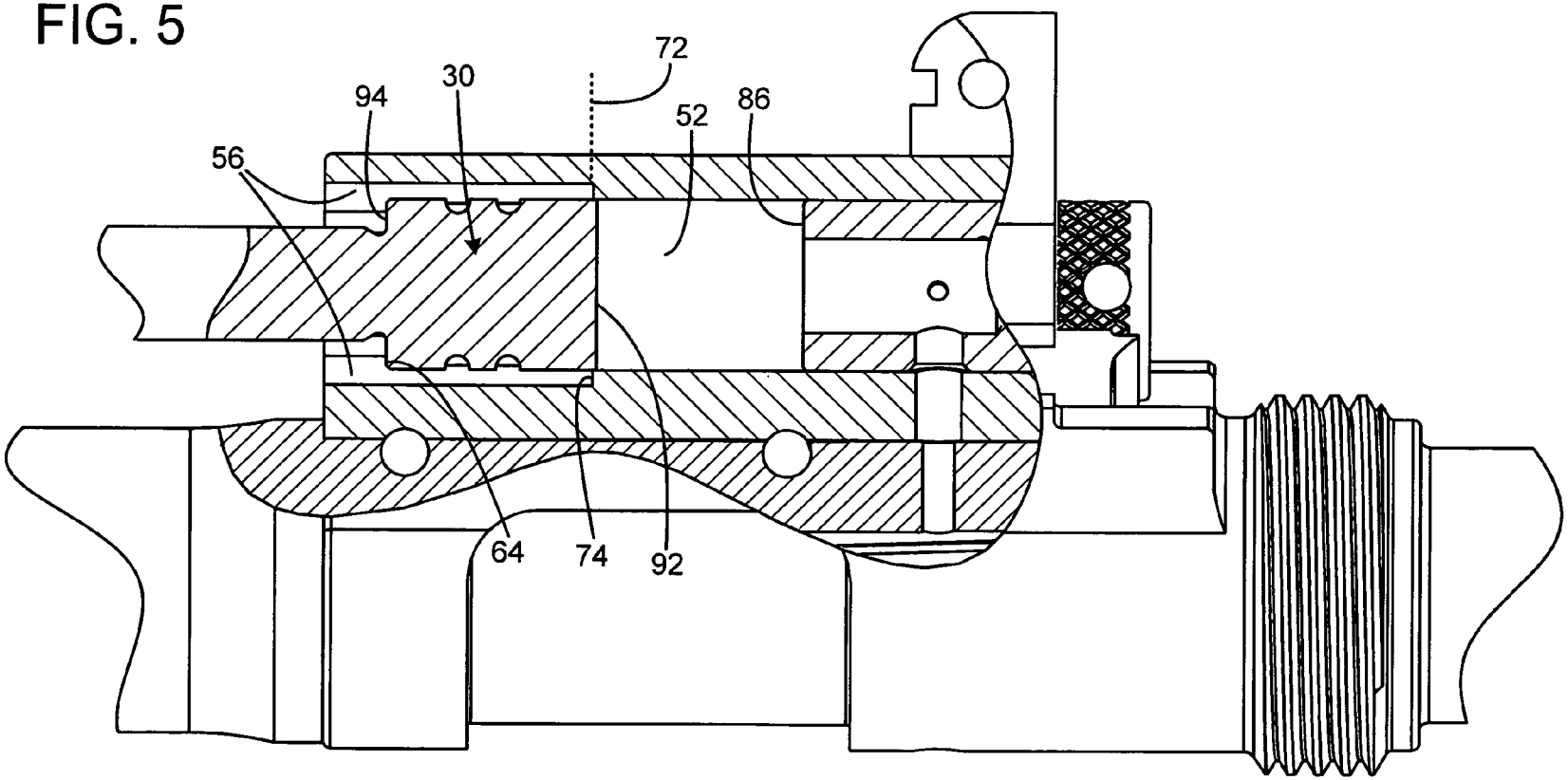
FIG. 5 is an enlarged side view of the preferred embodiment in a second operational condition.

In FIG. 5, the piston 30 is in a rearmost position in which the rear shoulder 94 abuts the shoulder 64 of the gas block. Because the length of the piston (0.550 inch in the preferred embodiment) is slightly greater than the distance between the shoulder 64 and the flute end face 74 (0.540 inch in the preferred embodiment) the face 92 of the piston never moves rearward far enough to expose the flutes 56. Consequently, the gas piston retains gas pressure in the chamber 52, so that it does not escape rearwardly toward the shooter. Instead, the gas pressure dissipates back through a gas hole through which it entered. An external vent providing communication with the atmosphere may also be provided in the gas block.

The flutes 56 provide that portions of the piston running nearly its entire length are exposed when the piston is in the rearward position. This permits any accumulated debris or fouling to be readily shed each time the piston cycles. Because the piston is free to rotate, different portions of the piston service are exposed during operation, so that any localized fouling build up is readily shed.

In alternative embodiments, the relationship between the plane 72 and the forward face of the piston while in the rearward position may be varied. Instead of the face being slightly forward of the end of the flutes, the face may be aligned precisely with the ends of the flutes, or may even be positioned slightly rearward of the flute ends. This may be desirable in circumstances in which gas needs to be vented rearward. This may be desired because atmospheric vents on the gas block can create a visible jet that can be seen in darkness. Exposed vents can also burn the user is the jet is adjacent to exposed skin. In the illustrated embodiment, the rearward venting path extends into a protected space within the shrouded handguard that surrounds the barrel to the rear of the gas block, preventing exposure and visibility of the vented gases.

Figure 6:
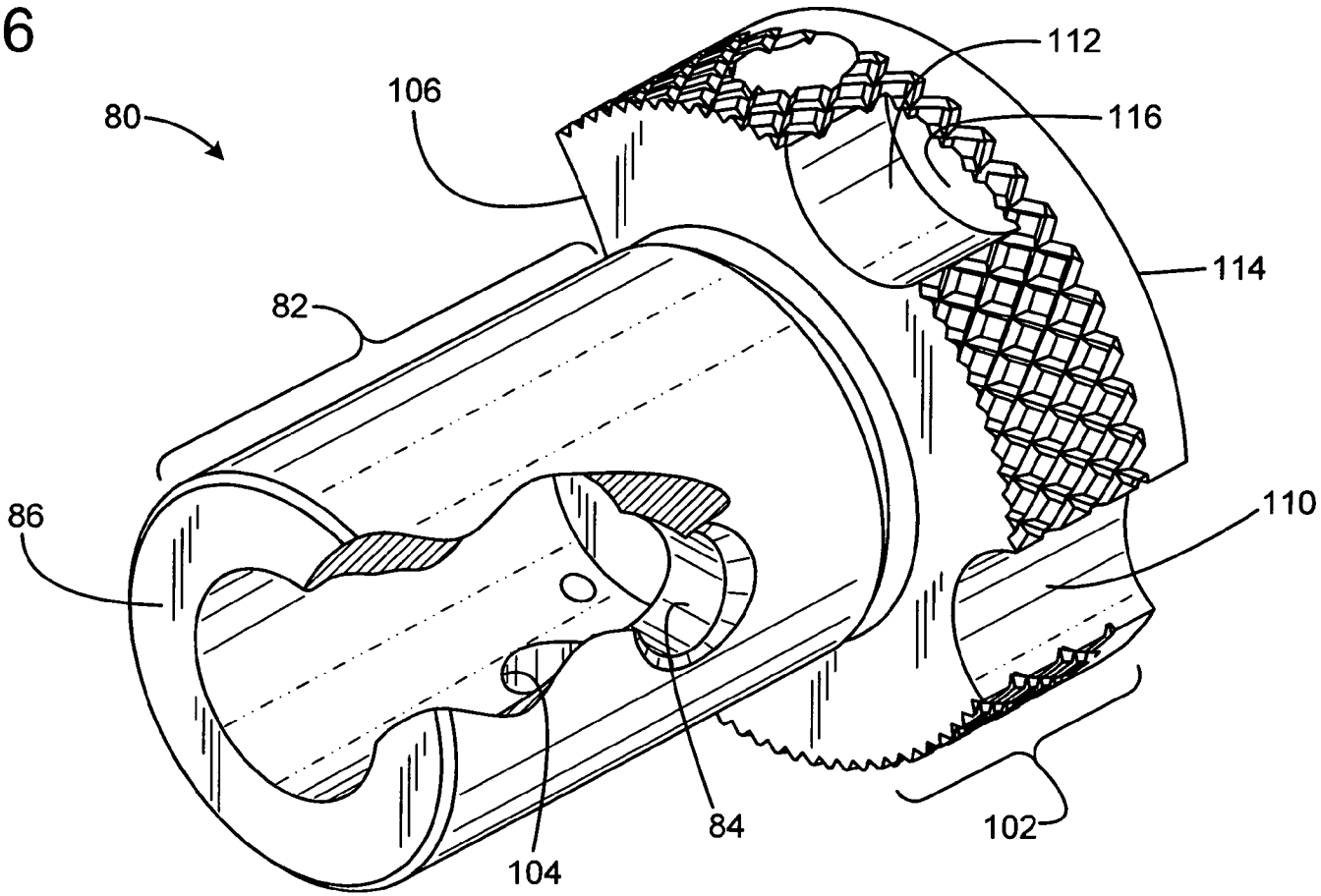
FIG. 6 is an enlarged perspective view of a gas plug according to a preferred embodiment of the invention.

FIG. 6 shows the gas plug 80. The gas plug's rear cylindrical section 82 is connected at its forward end to a forward portion 102 that has the form of an enlarged circular disk. The rear section 82 includes a first lateral inlet aperture 84 and a smaller lateral inlet aperture 104, both of which are positioned at a similar distance from the rear face 86 of the plug. Consequently, they may be registered with the barrel vent 70, depending on the rotational orientation of the plug. This provides a choice of two different effective aperture sizes, with the aperture being selected based on the position of the plug. In general, the larger aperture 84 is employed for normal rifle operations, and the smaller aperture 104 is employed when a sound suppressor is attached to the muzzle. This is because the aperture tends to generate greater and more prolonged back pressure, which provides more energy to the operating system than is desired.

The forward portion 102 of the gas plug has several features defined in its periphery. A large arcuate scallop 106 is defined in about one third of the periphery, and serves to provide clearance for installation of the gas plug. A semicylindrical passage 110 extends through the entire thickness of the forward portion 102, providing a small "bite" in the edge of the disk. A second semicylindrical pocket 112 is defined at another position on the disc's periphery, separated from the first passage 110 by the same rotational angle by which aperture 84 is separated from aperture 104. Pocket 112 differs from passage 110 in that it does not extend the full thickness of the disk. The pocket 112 extends only about two thirds of the thickness of the disk, so that it does not penetrate the front surface 114 of the disk. The pocket thus defines a rearward facing surface 116 that represents the forward limit of the pocket.

In the preferred embodiment, the passage 110 and pocket 112 are angularly separated. The passage 110 and pocket 112 have a common radius, with their axes extending parallel to the axis of the plug.

Figure 7B:
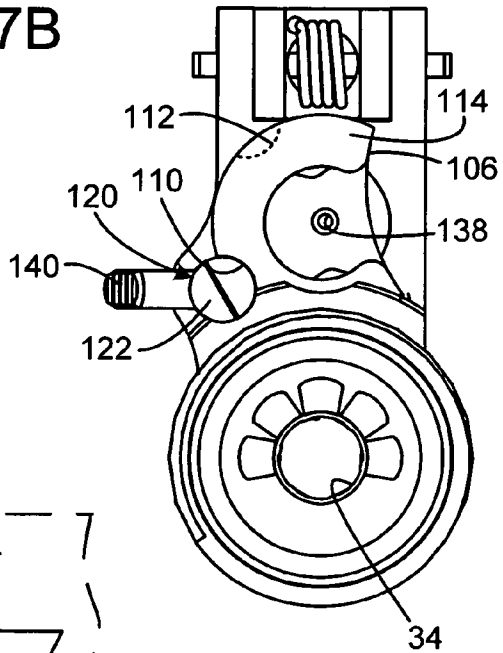
FIGS. 7A and 7B are side and end views of the preferred embodiment with a first gas plug setting.
Figure 7A:
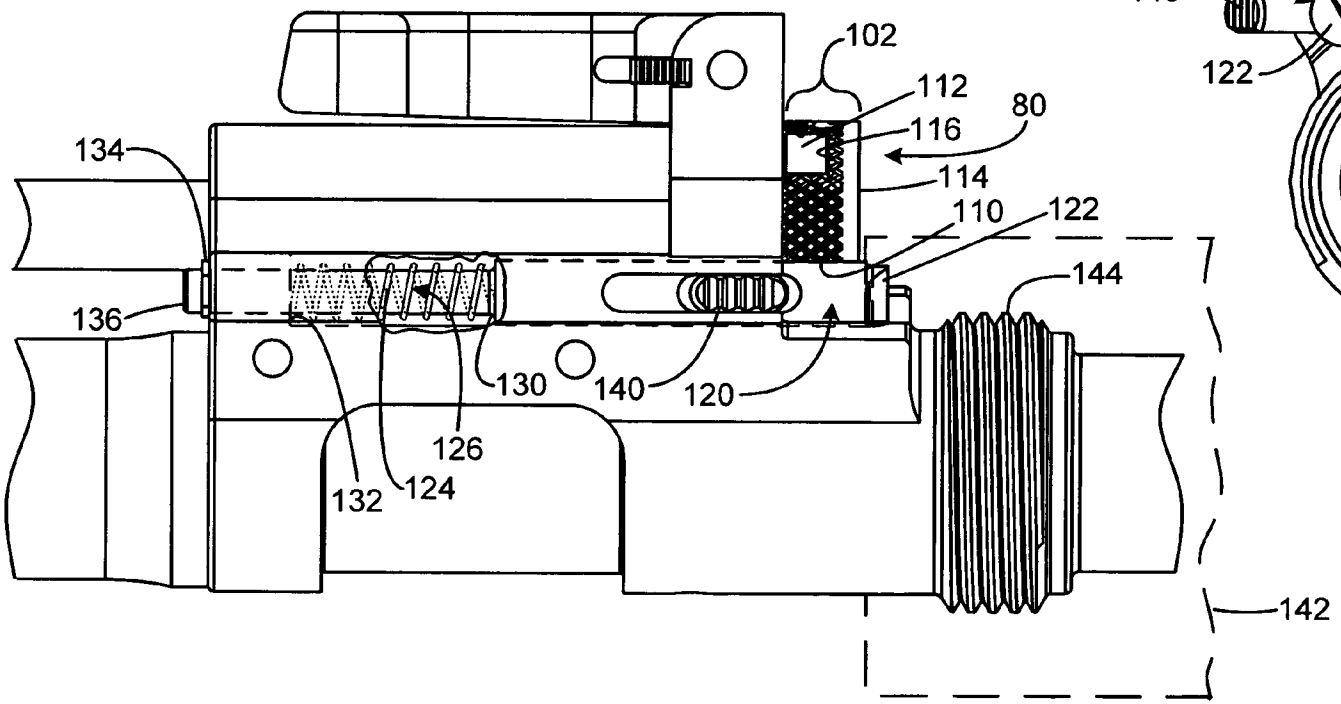

FIGS. 7A and 7B show a captive latch pin element 120 that is essentially an elongated rod oriented parallel to the firearm axis that reciprocates along the axis. The latch is biased in a forward direction to a forward position as shown. The forward end of the latch includes an angled cam surface 122, and the rest of the latch is received within a bore 124 defined within the gas block. A coil spring 126 within the bore provides biasing, by generating pressure between a shoulder 130 on the latch pin and a shoulder 132 within the bore 124. A C-ring 134 is received by a circumferential groove near the rear end 136 of the latch pin, and is installed on the pin after the pin is installed in the bore to limit forward excursion of the latch. The body of the pin is a smooth cylinder with a diameter sized to closely fit within the channel 110. A vent aperture 138 axially drilled in the front of the gas plug provides a gas passage between the bore of the gas plug and atmosphere, so that gas pressure in the plug is dissipated after firing each shot.

Figure 8B:
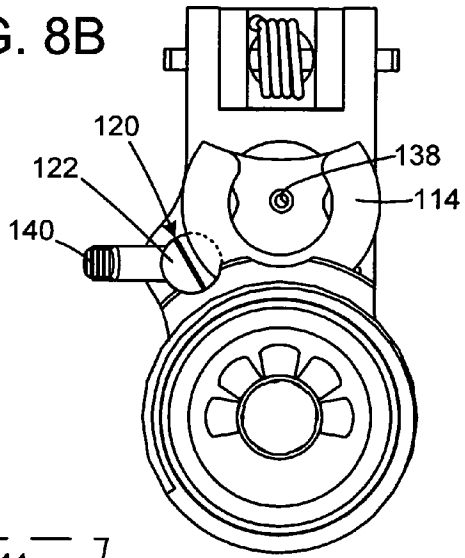
FIGS. 8A and 8B are side and end views of the preferred embodiment with a second gas plug setting.
Figure 8A:
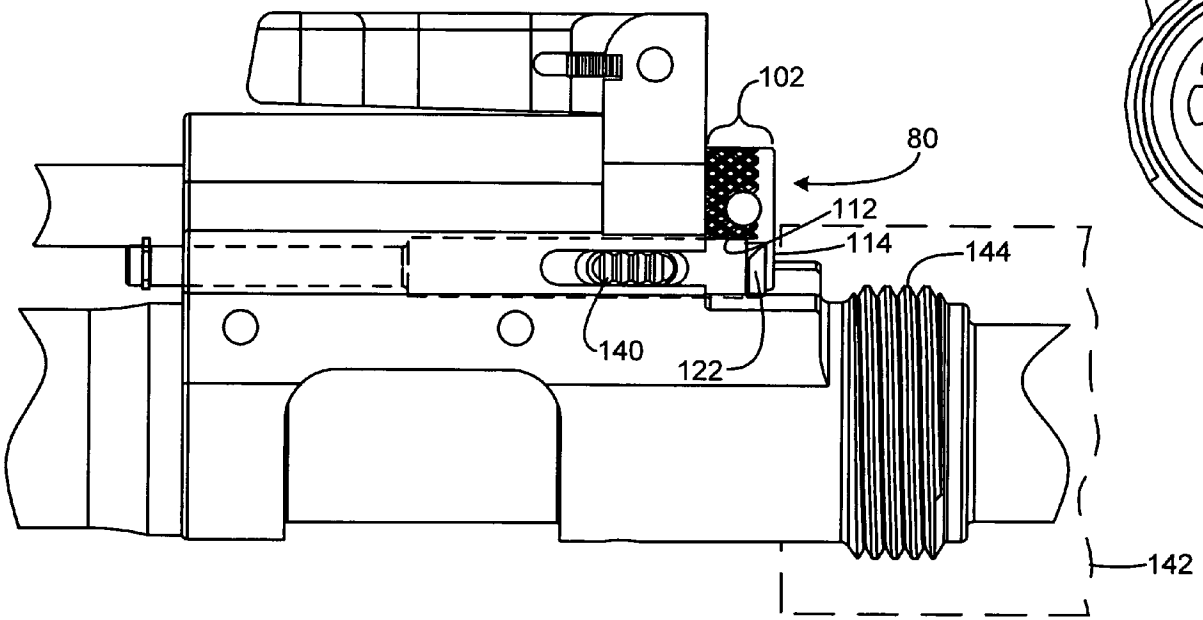

The setting of the gas plug is changed by sliding a button 140 that extends laterally from the pin in a rearward direction until the forward end of the latch is to the rear of the forward section 102 of the gas plug. This allows the plug to be rotated, such as to align the pocket 112 with the latch. As shown in FIGS. 8A and 8B, the gas plug 80 has been rotated into a second position, in which the latch extends into the pocket 112, securing the plug against rotation. A forward portion of the latch rests against the surface 116, preventing the forward end of the latch from extending beyond the forward face 114 of the gas plug.

Thus, while the gas plug is secured against rotation in either of the positions shown, the protruding latch shown in FIG. 7A indicates that the smaller hole 104 is providing limited gas flow from the barrel, while the partially retracted latch shown in FIG. 7B indicates that the larger hole 84 is providing gas flow.

Figure 9:
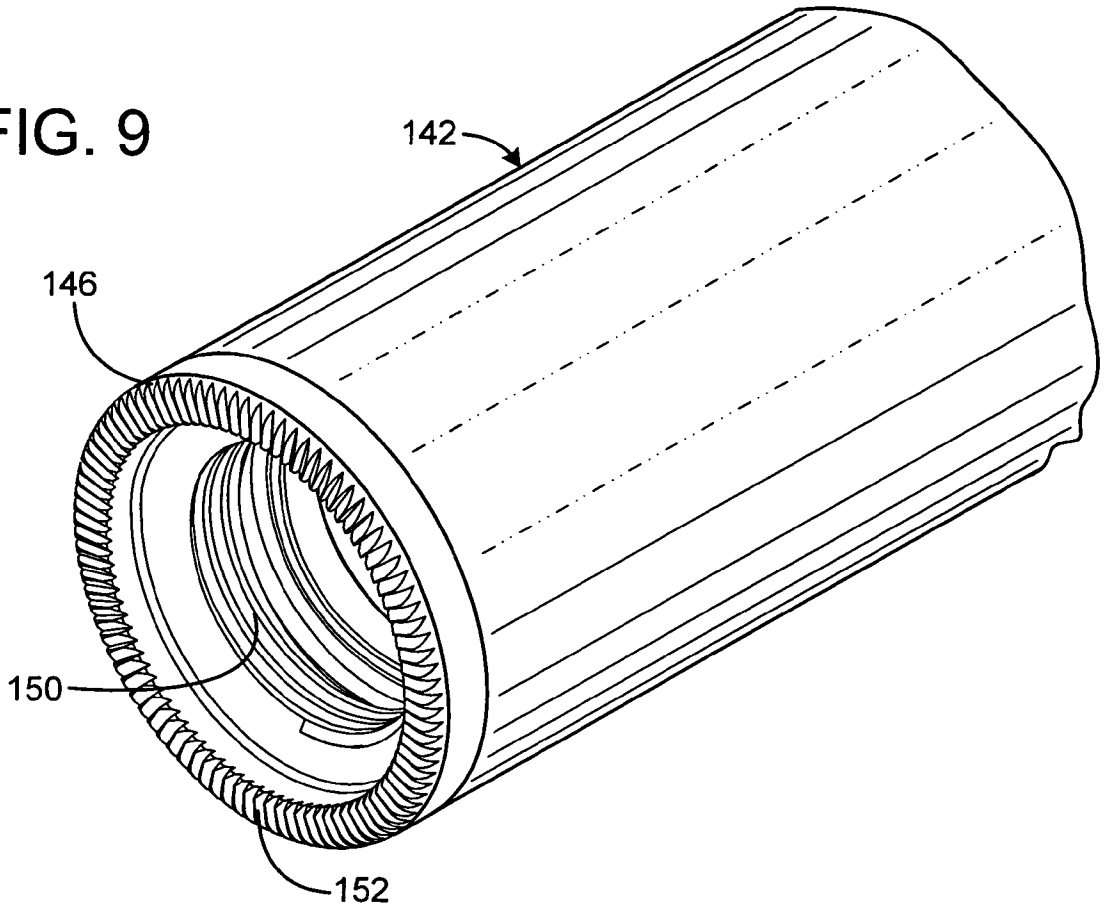
FIG. 9 is a sound suppressor for use with the preferred embodiment.
Figure 10:
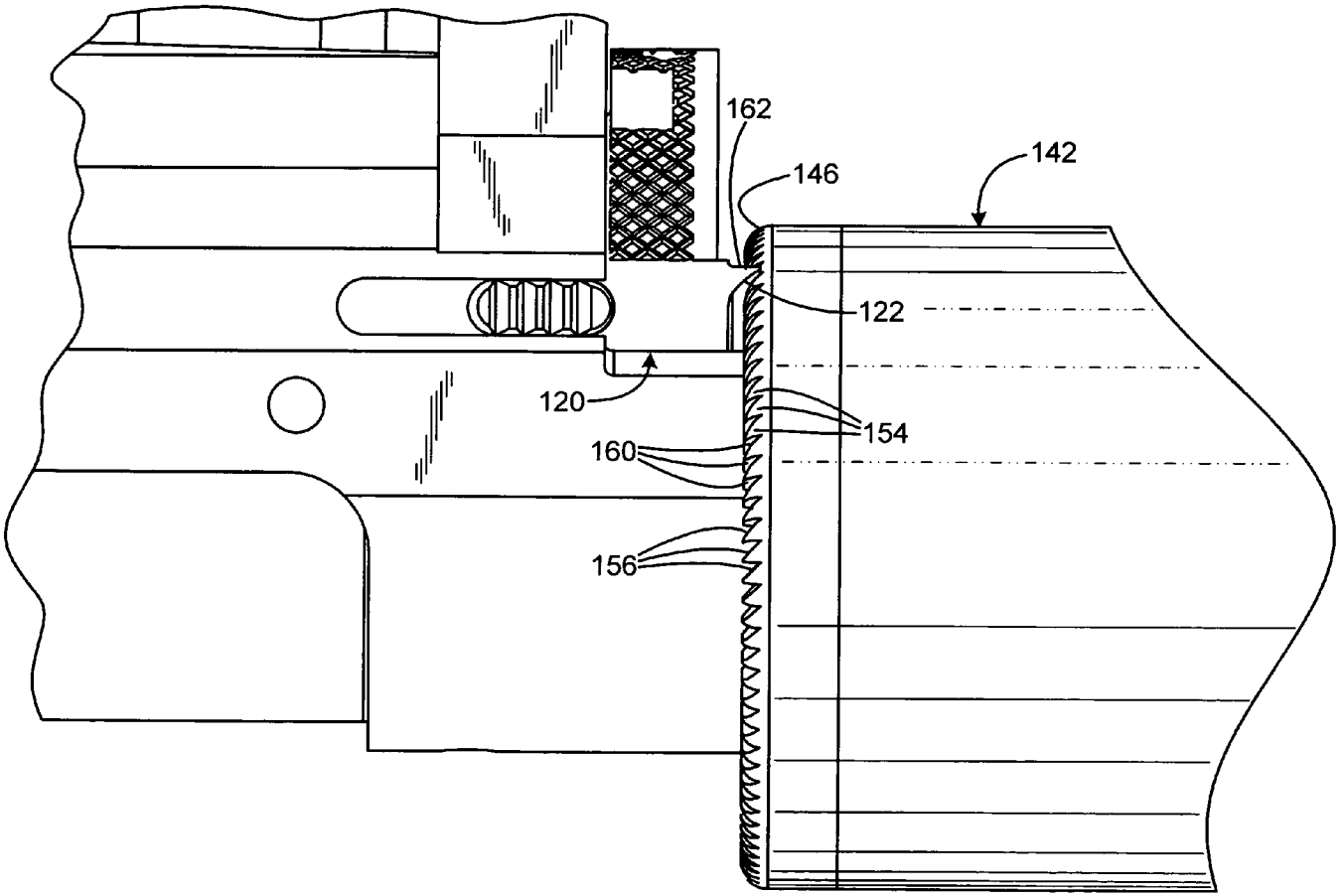
FIG. 10 is a sectional view of the suppressor attached to the preferred embodiment.

This feature of latch position depending on plug position is used beneficially when a muzzle mounted sound suppressor 142 is secured to the threads 144 at the forward end of the gas block element. As shown in FIG. 9, the suppressor 142 has a rear end 146 defining a threaded bore 150 with threads that engage the threads 144 on the gas block. The rear face of the suppressor includes a annular ring 152 having a pattern of notches or teeth 154. As shown in FIG. 10, each tooth 154 has an angled forward face 156 that is angled to match the cam surface 122 of the latch 120. Each tooth has a flat back face 160 that is perpendicular to the plane of the rear face 146, and aligned radially with respect to the axis of the suppressor.

The interaction of the suppressor teeth 154 and the latch 120 (when in the extended position shown in FIG. 10 and in FIG. 7A) provides multiple benefits. First, it prevents unwanted loosening of an attached suppressor. A flat rear face 162 of the latch engages its corresponding face 160 of the suppressor, keeping the suppressor securely attached until the latch is deliberately retracted to allow it to be unscrewed. This provides important safety benefits by avoiding the dangerous condition of firing with a loose and misaligned suppressor.

When the suppressor is installed by screwing in onto the threads 144, as it moves rearward interposition, the suppressor teeth 154 begin to encounter the latch 120. Normally, the latch is not retracted during this process and the cam surface 122 engages the angled surfaces 156 of the suppressor. Because of the matching angles, the cam is pushed rearward by the teeth as each tooth passes, and operates like a ratchet. This provides clear tactile and audible feedback to the user, reminding him that the gas plug is in the desired position intended for suppressor usage. Should the user have forgotten to set the gas plug in the proper position, he will receive no feedback from the ratchet mechanism. This will be a clear indication that the plug setting is in error, allowing the setting to be corrected in avoiding the associated risk and damage.

When a suppressor is not used, but the plug is in the setting for suppressor use, the protruding latch provides visual indication of an improper gas plug setting.

Alternative Embodiment

Figure 11:
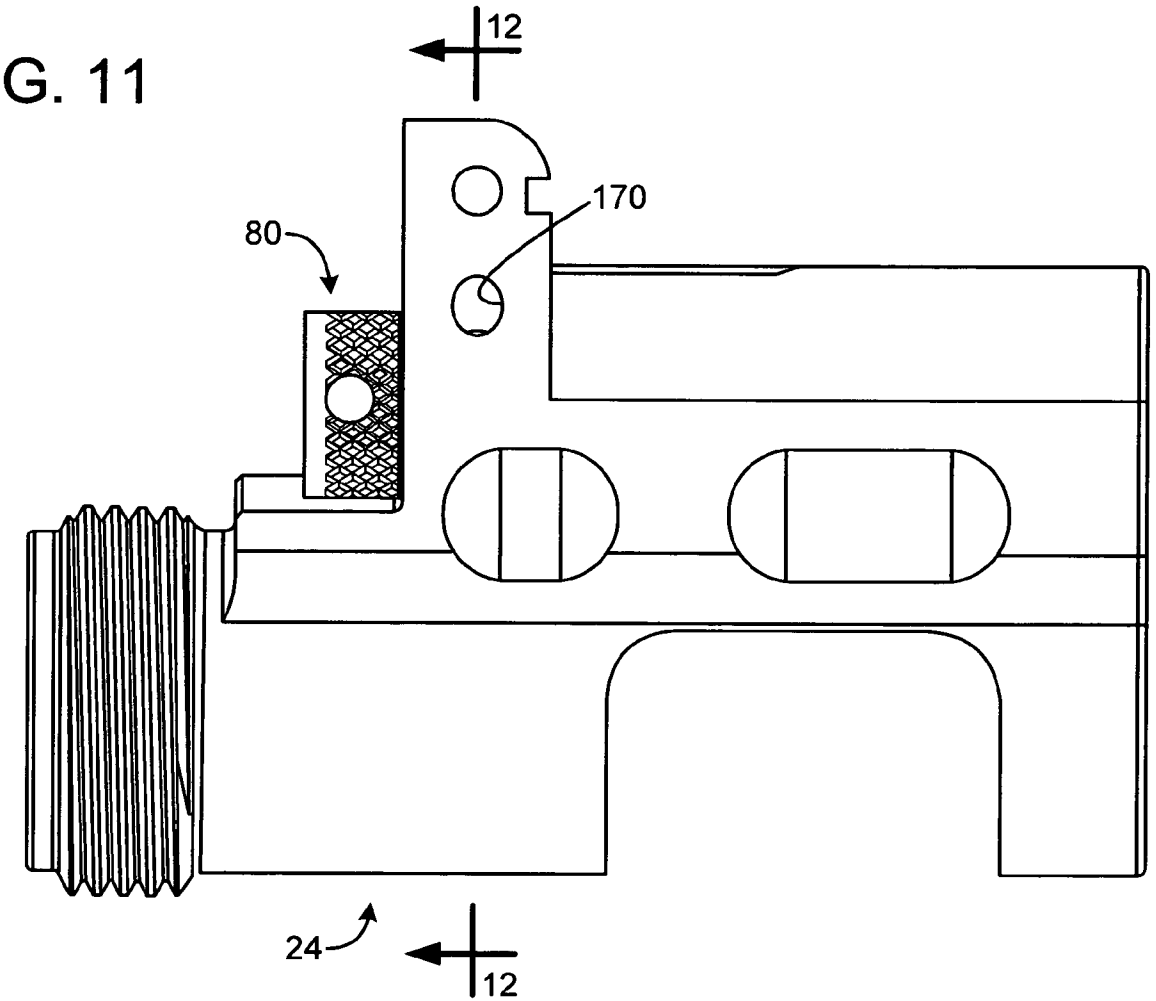
FIG. 11 is a side view of the gas block of the preferred and alternative embodiment.

FIG. 11 shows the gas block 24 on the left side, illustrating a vent hole 170 that exists in either embodiment. As discussed above, gas pressure in the gas block chamber is dissipated through the vent hole, at a relative slow rate following exit of the bullet from the muzzle. In the embodiment above, the cylindrical portion 82 of plug 80 includes two vent apertures, each registering with the vent hole 170 for one of the gas plug positions discussed above. In the above embodiment, the cylinder vent holes are equal in size. They may be larger than the vent hole 170, which is sized to limit flow, or they may be smaller, to provide the vent flow limitation orifice.

Figure 12:
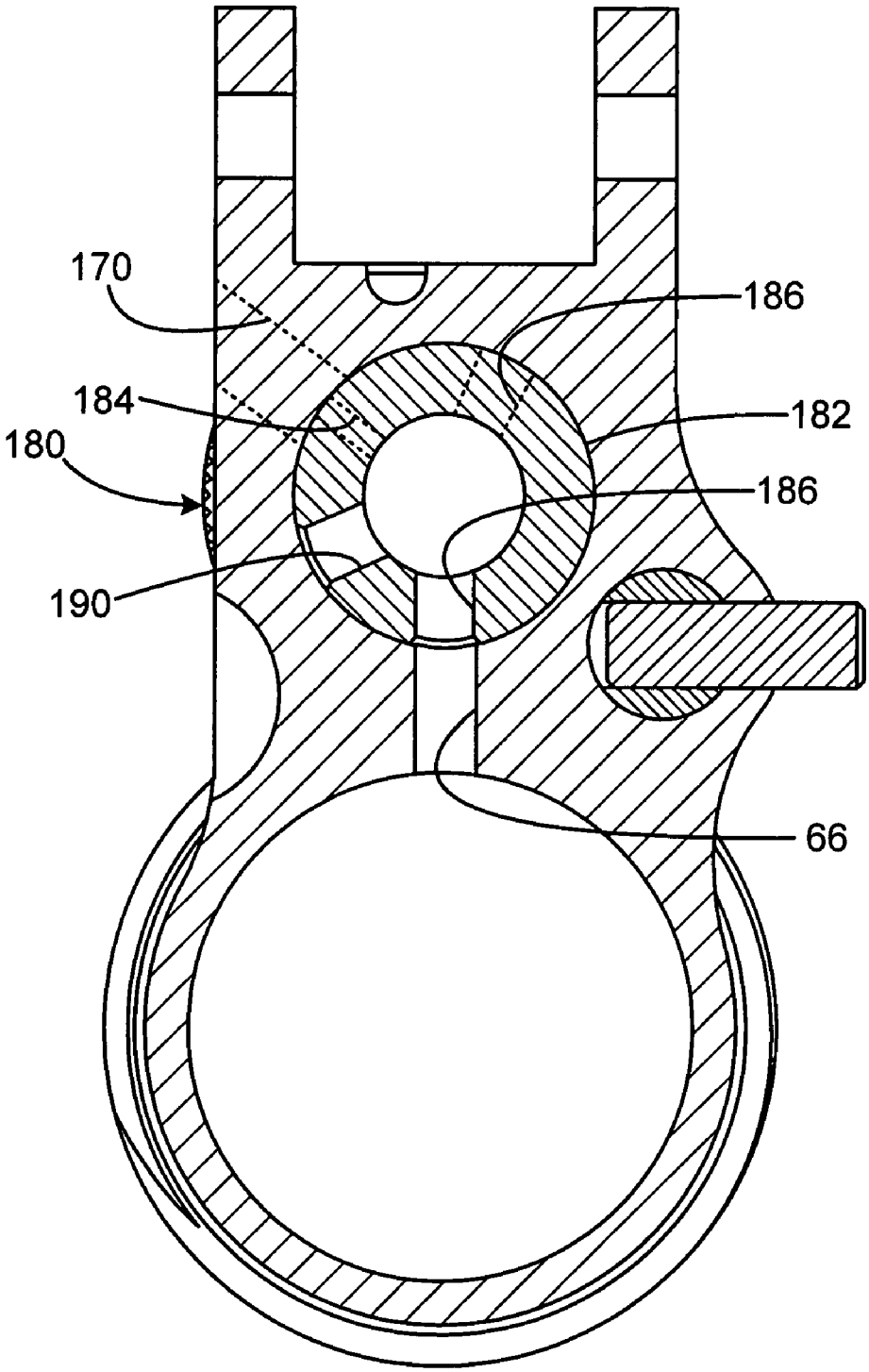
FIG. 12 is a sectional view taken along line 12-12 of FIG. 11, of a gas plug according to an alternative embodiment.

An alternative plug 180 is shown in FIG. 12, with a cylindrical portion 182 defining at a forward position a small vent aperture 184 and a large vent aperture, each of which registers with gas block vent hole 170 when in one of the two plug positions. In this embodiment, a corresponding pair of inlet apertures 186, 190 are defined in the plug's cylindrical portion at a position rearward of the vent apertures. The inlet apertures are of the same large size, each registering with the gas block aperture 66 when in the two respective operational positions. These provide gas transmission from the barrel to operate the action. All functions of interaction with the suppressor are the same as in the above embodiment, and this alternative is shown to indicate that either the gas block inlet or outlet (vent) adjustment may be used to provide functionality with or without a suppressor, and with the latch used to indicate whether the plug is in a suitable position for suppressor operation.

While the above is discussed in terms of preferred and alternative embodiments, the invention is not intended to be so limited.

The invention claimed is:

1. A firearm comprising;

a body;

a bolt assembly reciprocating within the body;

a barrel defining a bore and extending from the body;

a gas block defining a chamber and connected to the barrel;

the gas block and barrel defining a first gas passage communicating between the barrel bore and the gas block chamber;

the gas block defining a second gas passage communicating between the gas block chamber and an atmosphere outside of the gas block;

a gas regulation element having a first position and a second position, the regulation element operable to constrict at least one of the first and second gas passages by different amounts in the first and second positions; and the gas regulation element including a latch element operable to engage an accessory device mounted to the firearm when the gas regulation element is in the first position, and operable to remain disengaged from the accessory device mounted to the firearm when the gas regulation element is in the second position; and wherein the accessory device is a sound suppressor.

2. The firearm of claim 1 wherein the accessory device is mounted to a muzzle end of the barrel.

3. The firearm of claim 1 wherein the latch element is operable to provide tactile feedback in response to installation of the accessory device when the gas regulation element is in the first position.

4. The firearm of claim 1 wherein the latch element is operable to prevent unintended loosening and removal of the accessory device when in the first position.

5. The firearm of claim 1 wherein the accessory device is threadably attached to the firearm.

6. The firearm of claim 1 wherein the accessory device includes an annular array of engagement elements operable to engage the latch as the accessory device is rotationally connected to the firearm.

7. The firearm of claim 1 wherein the latch reciprocates along an axis, has a cam surface angled to the axis and operable to contact engagement elements on the accessory device.

8. The firearm of claim 1 wherein the latch is a spring loaded element that biased into engagement with the accessory device.

9. The firearm of claim 1 wherein the latch element in the first position operates to permit installation of the accessory device while giving tactile feedback during installation, and to secure the installed accessory device against unintended loosening and removal.

10. The firearm of claim 1 wherein the latch element reciprocates on a latch axis parallel to the bore, and where the gas regulation element has a first passage positioned to register with the latch axis and to permit the latch element to protrude beyond the regulation element when the regulation element is in the first position, and a blocking element sized and to prevent the latch element from protruding beyond the regulation element.

11. The firearm of claim 10 including a second passage positioned to register with the latch axis when the regulation element is in the second position, and sized to receive the latch element, the blocking element being an end portion of the second passage.

12. The firearm of claim 1 wherein the latch element engages the gas regulation element to secure the regulation element in a rotational position against unintended rotation.

13. The firearm of claim 1 wherein the accessory device mounted to the firearm is a sound suppressor comprising:

a body defining a bore axis;

an attachment element providing engagement to a firearm by rotation of the body on the bore axis;

an annular array of engagement elements encircling the bore axis operable to engage a latch on the firearm to secure the suppressor against inadvertent loosening and removal.

14. The firearm of claim 13 wherein the body is a cylinder having a rear face, and wherein the engagement elements are on the rear face.

15. The firearm of claim 13 wherein each engagement element has a cam surface angled with respect to the bore axis, such that the cam surfaces will engage and bypass the latch upon rotational installation of the suppressor on the firearm.

16. The firearm of claim 13 wherein the engagement elements and the latch element cooperate to provide ratcheting engagement to permit suppressor attachment and prevent suppressor removal without manual actuation of the latch.

17. The firearm of claim 1 wherein the gas regulation element is operable to provide different gas flow characteristics in each of the first and second positions and the latch element is operable to provide a user-detectable feedback upon installation of an accessory device when the gas regulation element is in the first position, and to refrain from providing the a user-detectable feedback when the gas regulation element is in the second position, such that the user receives the feedback when installing the accessory device only when the gas regulation element is in a position compatible with use of the accessory device.

18. The firearm of claim 17 wherein the latch element secures the gas regulation element in a selected position.

19. The firearm of claim 17 wherein the feedback is selected from a group of feedback types including audible and tactile feedback.

20. A firearm comprising;

a body;

a bolt assembly reciprocating within the body;

a barrel defining a bore and extending from the body;

a gas block defining a chamber and connected to the barrel;

the gas block and barrel defining a first gas passage communicating between the barrel bore and the gas block chamber;

the gas block defining a second gas passage communicating between the gas block chamber and an atmosphere outside of the gas block;

a gas regulation element having a first position and a second position, the regulation element operable to constrict at least one of the first and second gas passages by different amounts in the first and second positions;

the gas regulation element including a latch element operable to engage an accessory device mounted to the firearm when the gas regulation element is in the first position, and operable to remain disengaged from the accessory device mounted to the firearm when the gas regulation element is in the second position; and wherein the latch reciprocates along an axis, has a cam surface angled to the axis and operable to contact engagement elements on the accessory device.

21. A firearm comprising;

a body;

a bolt assembly reciprocating within the body;

a barrel defining a bore and extending from the body;

a gas block defining a chamber and connected to the barrel;

the gas block and barrel defining a first gas passage communicating between the barrel bore and the gas block chamber;

the gas block defining a second gas passage communicating between the gas block chamber and an atmosphere outside of the gas block;

a gas regulation element having a first position and a second position, the regulation element operable to constrict at least one of the first and second gas passages by different amounts in the first and second positions;

the gas regulation element including a latch element operable to engage an accessory device mounted to the firearm when the gas regulation element is in the first position, and operable to remain disengaged from the accessory device mounted to the firearm when the gas regulation element is in the second position; and wherein the latch element in the first position operates to permit installation of the accessory device while giving tactile feedback during installation, and to secure the installed accessory device against unintended loosening and removal.

22. A firearm comprising;

a body;

a bolt assembly reciprocating within the body;

a barrel defining a bore and extending from the body;

a gas block defining a chamber and connected to the barrel;

the gas block and barrel defining a first gas passage communicating between the barrel bore and the gas block chamber, the gas block defining a second gas passage communicating between the gas block chamber and an atmosphere outside of the gas block;

a gas regulation element having a first position and a second position, the regulation element operable to constrict at least one of the first and second gas passages by different amounts in the first and second positions;

the gas regulation element including a latch element operable to engage an accessory device mounted to the firearm when the gas regulation element is in the first position, and operable to remain disengaged from the accessory device mounted to the firearm when the gas regulation element is in the second position; and wherein the latch element reciprocates on a latch axis parallel to the bore, and where the gas regulation element has a first passage positioned to register with the latch axis and to permit the latch element to protrude beyond the regulation element when the regulation element is in the first position, and a blocking element sized and to prevent the latch element from protruding beyond the regulation element.

23. The firearm of claim 22 including a second passage positioned to register with the latch axis when the regulation element is in the second position, and sized to receive the latch element, the blocking element being an end portion of the second passage.

24. A firearm comprising;

a body;

a bolt assembly reciprocating within the body;

a barrel defining a bore and extending from the body;

a gas block defining a chamber and connected to the barrel;

the gas block and barrel defining a first gas passage communicating between the barrel bore and the gas block chamber;

the gas block defining a second gas passage communicating between the gas block chamber and an atmosphere outside of the gas block;

a gas regulation element having a first position and a second position, the regulation element operable to constrict at least one of the first and second gas passages by different amounts in the first and second positions;

the gas regulation element including a latch element operable to engage an accessory device mounted to the firearm when the gas regulation element is in the first position, and operable to remain disengaged from the accessory device mounted to the firearm when the gas regulation element is in the second position; and wherein the latch element engages the gas regulation element to secure the regulation element in a rotational position against unintended rotation.

* * * * *